United States Patent [19]

Van Sice

[11] Patent Number: 4,834,127

[45] Date of Patent: May 30, 1989

[54] SELF-FASTENING CANE HANDLE AND CANE ASSEMBLY

[75] Inventor: David P. Van Sice, Cincinnati, Ohio

[73] Assignee: The Kendall Co., Boston, Mass.

[21] Appl. No.: 157,957

[22] Filed: Feb. 19, 1988

Related U.S. Application Data

[60] Continuation-in-part of Ser. No. 150,752, Feb. 1, 1988, which is a division of Ser. No. 853,131, Apr. 17, 1986, Pat. No. 4,730,632.

[51] Int. Cl.[4] ..... A45B 9/02

[52] U.S. Cl. ..... 135/76; 135/72; 403/298; 403/356

[58] Field of Search ..... 403/298, 402, 356, 172; 280/819, 820, 821; 135/72, 76

[56] References Cited

U.S. PATENT DOCUMENTS

| | | |
|---|---|---|
| D. 10,616 | 4/1878 | Kaldenberg . |
| D. 42,960 | 9/1912 | Disston . |
| D. 65,507 | 8/1924 | Tracy . |
| 71,460 | 11/1867 | Crossley . |
| 84,457 | 11/1868 | Witzil . |
| D. 153,407 | 6/1948 | Weaver . |
| 156,369 | 10/1874 | Millspaugh . |
| 157,634 | 12/1874 | Reagan . |
| D. 184,860 | 4/1959 | Dreier . |
| D. 185,293 | 5/1959 | Lord . |
| D. 187,842 | 5/1960 | Jeys . |
| D. 192,068 | 1/1962 | Franklin et al. . |
| D. 198,518 | 6/1964 | Beubring . |
| D. 199,720 | 12/1964 | Wainerdi . |
| D. 207,764 | 5/1967 | Lozo et al. . |
| D. 208,245 | 8/1967 | Peterson . |
| D. 209,943 | 1/1968 | Kurpis . |
| D. 231,043 | 3/1974 | Barnett . |
| D. 266,644 | 10/1982 | Shimizu . |
| 272,007 | 2/1883 | Woodrough . |
| 298,115 | 5/1884 | Peach . |
| 566,306 | 8/1896 | Goldsmith . |
| 605,708 | 6/1898 | Fretz . |
| 666,646 | 1/1901 | Burtis . |
| 768,452 | 8/1904 | Hennessy . |
| 1,086,310 | 2/1914 | Thrun . |
| 1,329,915 | 2/1910 | McKensie . |
| 1,375,912 | 4/1921 | Huddle . |
| 1,719,458 | 7/1929 | Visitacion . |
| 1,930,501 | 10/1933 | Aronson . |
| 1,952,980 | 3/1934 | Fox . |
| 2,146,495 | 2/1939 | Amdur . |
| 2,269,029 | 1/1942 | Lounsbery . |
| 2,282,902 | 5/1942 | Sultan . |
| 2,309,816 | 2/1943 | Allen . |
| 2,361,256 | 10/1944 | Barland . |
| 2,409,365 | 10/1946 | Lamb . |
| 2,435,650 | 2/1948 | Greene . |
| 2,520,890 | 8/1950 | Priest . |

(List continued on next page.)

FOREIGN PATENT DOCUMENTS

| | | | |
|---|---|---|---|
| 126477 | 12/1901 | Fed. Rep. of Germany | 135/76 |
| 1014469 | 8/1957 | Fed. Rep. of Germany | 280/819 |
| 2739101 | 10/1987 | Fed. Rep. of Germany | 280/819 |
| 73402 | 10/1916 | Switzerland . | |
| 2067257 | 7/1981 | United Kingdom . | |

OTHER PUBLICATIONS

Jung Trade Catalog, 1985, p. 3.

*Primary Examiner*—Henry E. Raduazo
*Attorney, Agent, or Firm*—Wood, Herron & Evans

[57] ABSTRACT

A cane handle is provided with a novel fastenerless lock for securing the handle to a tubular shaft to form a cane assembly. The fastenerless lock includes a depending stub shaft formed integrally with the handle, that stub shaft having a series of annular lock flanges oriented generally normally to the stub shafts' longitudinal axis. The lock flanges are deformable and have an outside diameter in their undeformed, pre-assembly state, that is slightly greater than that of the inside diameter of the tubular shaft into which the stub shaft bearing the lock flanges is inserted to form a cane assembly. Upon insertion into the tubular shaft, the flanges are deformed upwardly in generally dish shaped configuration that resists their subsequent withdrawal.

5 Claims, 2 Drawing Sheets

OTHER PUBLICATIONS

| | | | |
|---|---|---|---|
| 2,604,130 | 7/1952 | Derby . | |
| 2,606,584 | 8/1952 | Derr . | |
| 2,618,986 | 11/1952 | Hungerford . | |
| 2,696,233 | 12/1954 | Huxtable . | |
| 2,742,936 | 4/1956 | Cooley . | |
| 2,778,395 | 1/1957 | Forsberg . | |
| 3,029,828 | 4/1962 | Kravitt . | |
| 3,093,402 | 6/1963 | Sisson . | |
| 3,142,200 | 7/1964 | Stillman . | |
| 3,157,187 | 11/1964 | Murcott . | |
| 3,177,884 | 4/1965 | Thro . | |
| 3,269,399 | 8/1966 | Smith . | |
| 3,363,639 | 1/1968 | Jurpis . | |
| 3,482,586 | 12/1969 | Weber | 135/76 |
| 3,851,980 | 12/1974 | Worth et al. . | |
| 3,883,257 | 5/1975 | Delafield . | |
| 3,883,258 | 5/1975 | Hewson . | |
| 3,966,339 | 6/1976 | Nemecek et al. . | |
| 3,992,570 | 11/1976 | Beinhaur . | |
| 3,995,650 | 12/1976 | DiVito . | |
| 4,018,370 | 4/1977 | Wood | 403/298 |
| 4,288,101 | 9/1981 | Aho | 280/821 |
| 4,454,699 | 6/1984 | Strobl . | |

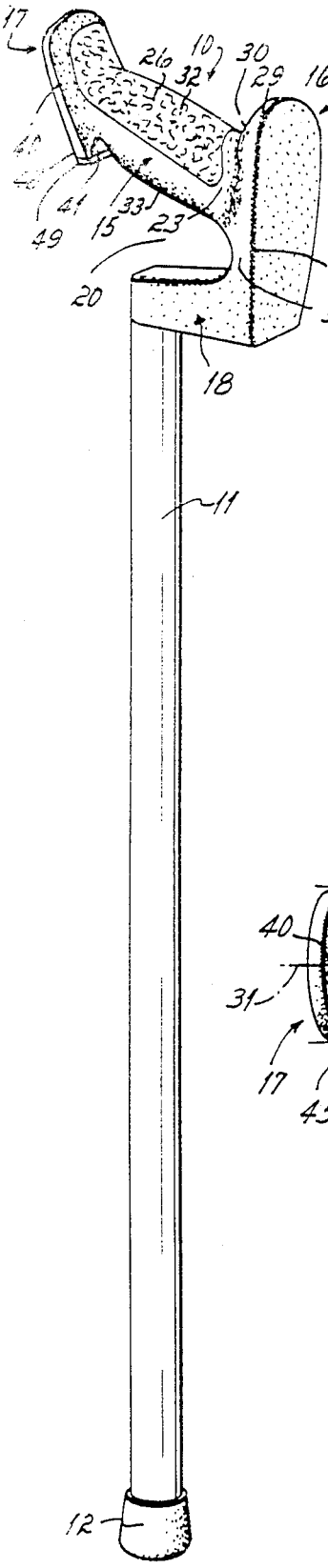
FIG. 1
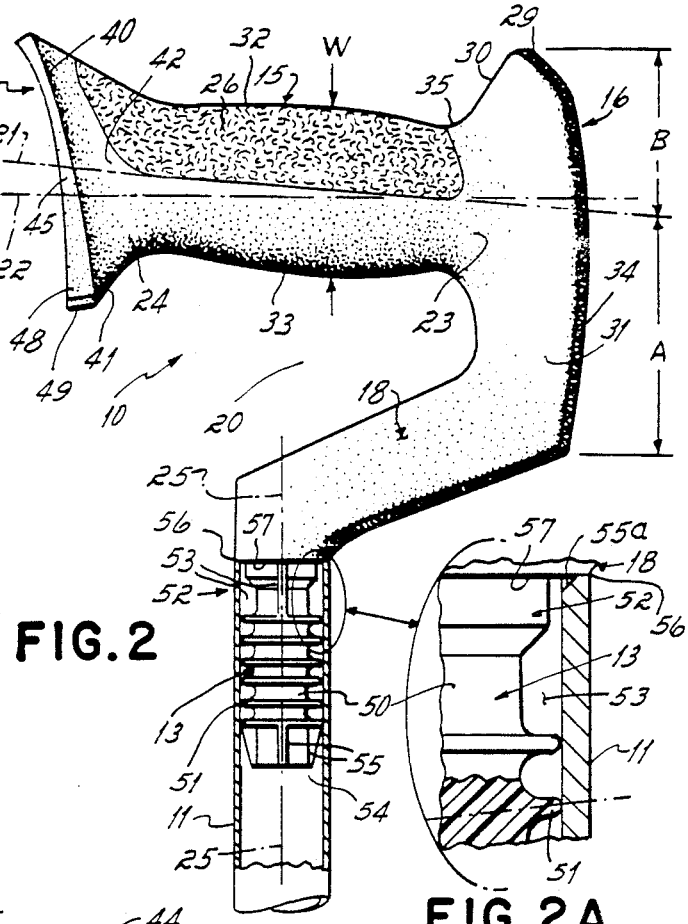
FIG. 2
FIG. 2A
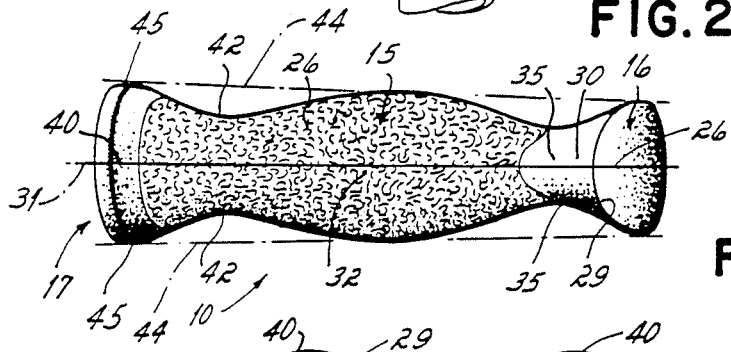
FIG. 3
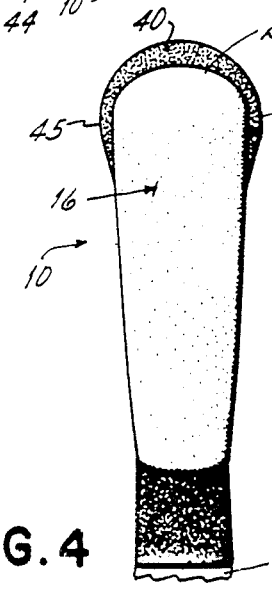
FIG. 4
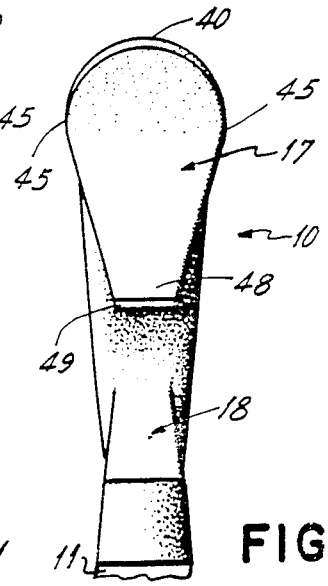
FIG. 5

SELF-FASTENING CANE HANDLE AND CANE ASSEMBLY

CROSS REFERENCE AND RELATED APPLICATIONS

This application is a Continuation-in-Part of U.S. patent application Ser. No. 150,752, filed Feb. 1, 1988 which in turn is a Divisional of U.S. patent application Ser. No. 06/853,131, filed Apr. 17, 1986, now U.S. Pat. No. 4,730,632 issued Mar. 15, 1988

This invention relates to canes. More particularly, this invention relates to a cane having a novel handle structure, and a novel fastenerless lock by which the handle is connected to a tubular shaft.

Canes are, of course, very well known to the prior art. Canes are primarily used by elderly people. And the hands of the elderly are often adversely affected by age type diseases, e.g., arthritis. So it is often difficult for elderly persons with, e.g., arthritic hands, to easily grip and hold onto a cane so it can be used in the intended fashion. Since elderly people may be somewhat unstable when walking in the first place (and that, of course, is the reason they need a cane), when the cane itself is hard to grip and, thereby, hard to use, the cane does not provide the elderly user with all the stability enhancement that is desired.

It has been the primary objective of this invention to provide an improved cane that is particularly adapted for use by elderly people, and particularly by elderly people whose hands are to some extent disabled due to age or disease or both.

In accord with this objective, the cane of this invention makes use of a one piece molded handle that is connectable to a tubular shaft. The handle, in preferred form, includes a hand grip section having an axis oriented about 5° relative to a line normal to the shaft's axis, includes a stippled or roughened area on the top surface of the hand grip to increase gripping friction with the user's hand, includes upstanding shoulders at the front and back ends of the handle that prevent the user's hands from slipping off the handle, includes index finger support ribs generally vertical to the hand grip's axis on both sides of the hand grip at the handle's front end to enhance control of the cane during use, includes a high friction tip on the handle's heel to prevent the cane from slipping off a tabletop or counter when it is hung by the handle thereon, and includes a fastenerless lock by which the handle is interconnected with the cane's tubular shaft.

Other advantages and inventions of this invention will be more apparent from the following detailed description taken in connection with the drawings in which:

FIG. 1 is a perspective view illustrating a cane in accord with the principles of this invention;

FIG. 2 is a side view illustrating the cane's handle; and also illustrating the fastenerless lock by which the cane's handle is connected with the cane's shaft;

FIG. 2A is an enlarged view of the encircled portion of FIG. 2.

FIG. 3 is a top view illustrating the cane's handle;

FIG. 4 is a front end view illustrating the cane's handle; and

FIG. 5 is a rear end view illustrating the cane's handle.

Figure 6:
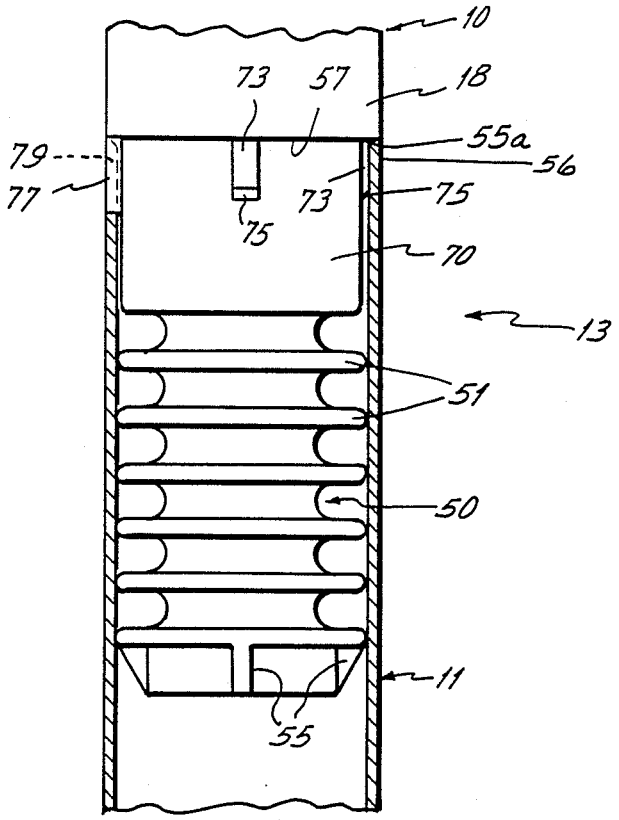
FIG. 6 is a partial, side sectional view illustrating an alternative construction of the fastenerless lock.

The cane of this invention is illustrated in assembled form in FIG. 1. The cane basically includes a cane handle 10, a cane shaft 11, and a cane foot 12. The cane handle 10 is of a molded one piece configuration that is interconnected with the tubular shaft 11 by a novel fastenerless lock 13. The cane foot 12 is in the form of a rubber tip that is frictionally fitted onto the bottom end of the tubular shaft 11.

The cane handle 10, as shown in the figures, includes a hand grip 15, a front end 16, a rear end 17, and a brace 18, all of a generally C-shaped configuration. The handle's hand grip 15, as shown in FIGS. 2 and 3, is of a generally elongated egg-shaped configuration 20 that has a centerline 21. When the cane shaft is oriented vertical as shown in FIG. 2, the hand grip axis 21 is angled at about 5° relative to the horizontal 22. Note that the front 23 and rear 24 ends of the hand grip ar equi-distantly spaced, i.e., the grip itself is centered, relative to the shaft's axis 25. The top surface of the hand grip 15, as shown in FIG. 2, is provided with a stippled or roughened surface area 26 for the purpose of increasing frictional resistance between the user's hand and the hand grip in order to minimize slipping of the user's hand on the cane handle 10 and, thereby, enhance safety during use of the cane.

The handle 10 further includes a front end shoulder 30 and a generally vertical index finger support 31 molded integral with the front end of the hand grip 15. This front end shoulder 30 and generally vertical index finger support 31 are symmetrical relative to the hand grip's longitudinal center plane 31. The front shoulder 30 extends up above the top surface area 32 of the hand grip 15, and the index finger support 31 extends downwardly beneath the bottom surface 33 of the hand grip 15. The index finger support 31 extends downwardly from the hand grip's axis 21 a distance A about one and one-half times the width W of the hand grip, and the front shoulder 30 extends up above the hand grip's axis 21 a distance B about equal to the width of the hand grip. The front shoulder 30 includes an arcuate rib 29 along its top edge, and a saddle 35 is defined by that front shoulder's surface area that curves downwardly from the top edge 29 as viewed from the side view. The index finger support 31 includes a concave arcuate rib 34 at the outer edge. The finger support 31 is curved inwardly from the rib 34 as at 35 when viewed from the top view to provide the index finger support area, on both sides of the cane handle, thereby permitting the cane to be used by a right handed or left handed person.

A rear shoulder 40 extends upwardly about the hand grip's top surface 32 as part of the rear end 17 of the hand grip 15, and a rear heel 41 extends downwardly beneath the hand grip's bottom surface 33, also as shown in FIG. 2. This rear shoulder 40/heel 41, which is symmetrical relative to the hand grip's longitudinal plane 26, is formed with the hand grip to provide inwardly curved indentation areas or valleys 42 adjacent the rear end of the hand grip to enhance useability or gripability of the grip. As shown in FIG. 3, and with a phantom line 44 drawn that contacts the index finger rib 34, the hand grip 15, and the rear shoulder's outer edge 45, the index finger support indentations or valleys 35 are clearly shown on each side of the handle, as well as the similar indentations or valleys 42 at the rear end of the handle.

The front 30 and rear 40 shoulders at the front 16 and rear 17 ends of the hand grip 15 help to keep the user's hand from slipping off the handle during use. And the index finger support 31 on both sides of the hand grip 15 aids in the support and gripability of the handle by an elderly person, as well as in the stability of the cane when it is being used. The fact that the hand grip is of generally egg-shaped configuration when viewed from the top, as well as the side, provides a broad cross-section area in the area of the middle of the user's hand in order to accommodate arthritic hands of the elderly.

A brace 18 molded integral with the index finger support 31 at one end, and that connects with the cane shaft 11 at the other end, completes the generally C-shaped configuration of the cane handle 10. This brace 18 permits the center of the hand grip to be located approximately on the shaft's center axis 25. And this, in turn, ensures that downward pressure of the user's hand is generally directly on, i.e., co-axial with, the cane's shaft 11 when the shaft is vertical. This aids in preventing the cane from tipping or sliding during use because hand pressure is directly in line with the shaft.

The bottom end 48 of the handle's rear heel 41 is provided with a high friction tip 49, e.g., a rubber tip. This rubber tip 49 defines a generally flat area of substantial width, see FIG. 5. Note particularly, as shown in FIG. 2, that the cane's rear end can be easily hung from the top of a table or counter while the cane shaft hangs down along the front of that table or counter. The high friction tip 49 on the rear of the cane's handle tends to prevent the cane from sliding off the table or counter where it has been temporarily placed by the user.

The cane handle 10 is interconnected with the cane's tubular shaft 11 by means of a fastener lock 13 that, once the interconnection is made, resists turning of the handle about the shaft's axis 25, and also prevents the handle from being pulled axially back out the shaft. This fastenerless lock 13, as shown in FIG. 2, includes a stub shaft 50 that is integral with and extends off the free end of the handle's brace 18, that stub shaft being axially alignable with the cane shaft's axis 25. The handle's stub shaft 50 includes a series of deformable lock flanges 51 normal to the cane and stub shaft's axis 25. The lock flanges 51, prior to assembly with the cane's tubular shaft 11, are each of a slightly greater outside diameter than the inside diameter of that shaft. These lock flanges 51 are spaced from the brace 18 by a non-rotation section 52 comprised of a series of four lock ribs 53 that extend radially outward from, and parallel to, the stub shaft's axis 25. The free end section 54 of the stub shaft 50 is provided with a series of guide ribs 55 that also radially extend from, and are oriented parallel to, the stub shaft's axis 25. These guide ribs 54 taper inwardly in a generally truncated configuration.

When the cane handle 10 is to be assembled with the cane shaft 11, the guide ribs 55 on the cane handle's stub shaft 50 cooperate with the beveled inside edge 55*a* of the tubular shaft's top end 56 so as to properly guide the stub shaft into assembly with the cane shaft. As the cane handle's stub shaft 50 is pushed or pressed into the cane shaft's open end 56, the lock flanges 51 are deformed or deflected upwardly in generally dish-shaped fashion in order to prevent the handle from being withdrawn from operational assembly with the tubular shaft 11. Further, and as the cane handle's stub shaft 50 is pushed downwardly into the shaft's open end 56 until seat 57 on the cane handle's brace 18 bottoms out against the top edge 56 of that tubular shaft 11, the lock ribs 53 are received within the tubular shaft 11, and tend to deform the circular interior of that shaft toward a cross-sectional configuration other than circular since the width of the stub shaft at the lock rib pairs is slightly greater than the inside diameter of the cane shaft. This deformation after assembly, tends to prevent rotational movement of the cane shaft 11 relative to the cane's handle 10. Accordingly, the fastenerless lock 13 incorporated on the stub shaft 50 of the cane's handle 10 cooperates with the hollow tubular top end 56 of the cane shaft 11 via the deformable friction fit rings 50 and non-deformable lock ribs 53 so that the friction fit rings resist pulling of the handle's stub shaft out from the cane shaft and so that the lock ribs resist turning of the handle's stub shaft relative to the shaft, thereby creating a permanent interconnect or lock between the two cane 10, 11 components.

An alternative construction of lock 13 will now be described with reference to FIG. 6. Except as pointed out below, this construction is similar to that previously described with reference to FIG. 2 and 2A with like reference numerals designating like parts. As shown in FIG. 6, lock 13 includes a stub shaft 50 that depends from the brace 18 of the cane handle in the same manner as the construction described above. Stub shaft 50 includes a similar series of annular, deflectable lock flanges 51 and terminates in a series of guide ribs 55, both flanges 51 and ribs 55 being constructed and operating in the manner previously described.

In the alternate construction shown in FIG. 6, the lock ribs 53 which operated as anti-rotation means by deforming tubular shaft 11, are eliminated. Instead, shoulder section 70 is formed between the seat portion 57 of brace 18 and the series of lock flanges 51. Shoulder section 70 has a cross-sectional shape substantially conforming to that of the interior of tubular shaft 11 and is sized for a close slip fit inside tubular shaft 11. The length of shoulder section 70 is preferably about one quarter to one half the length of stub shaft 50 to assist in stabilizing stub shaft 50 within tubular shaft 11.

To even further stabilize stub shaft 50 within tubular shaft 11, shoulder section 70 is provided with plural tabs 73 projecting radially outwardly from the surface of shoulder section 70 at a location just below the seat portion 57 of brace 18. Applicants prefer to use three such tabs 73 spaced at locations ninety degrees apart on the surface of shoulder section 70. A tapered surface 75 connecting tabs 73 with shoulder section 70 facilitates the insertion of tabs 73 within tubular shaft 11. Preferably, each tapered surface 75 is inclined at an angle of about forty five degrees. The tabs 73 project beyond the surface of shoulder section 70 a distance sufficient to displace the inner wall of tubular shaft 11 outwardly when stub shaft 50 is fully inserted into tubular shaft 11 so that the top end 56 of shaft 11 abuts the seat 57 on brace 18. The degree of displacement must be sufficient to cause the upper end 56 of tubular shaft 11 to elasticly deform. This elastic deformation causes tubular shaft to tightly grip tabs 73 to further stabilize stub shaft 50 within tubular shaft 11 to avoid any perceptible rocking of handle 10 relative tubular shaft 11.

While tabs 73 are tightly gripped by the upper end of tubular shaft 11, handle 10 is positively prevented from rotating be means of a key 77 formed on shoulder section 70. Key 77, which is located ninety degrees between adjacent tabs 73, engages a mating keyway 79 formed in the upper end of tubular shaft 11. As tabs 73 are inserted into tubular shaft 11, the key 77 on shoulder section 70 engages the keyway 79 provided in shaft 11 to prevent rotation of handle 10.

When the cane handle 10, made according to the alternative construction just described, is to be assembled with the cane shaft 11, the guide ribs 55 on the cane handle's stub shaft 50 cooperate with the beveled inside edge 55*a* of the tubular shaft's top end 56 so as to properly guide the stub shaft into assembly with the cane shaft 11. As the cane handle's stub shaft 50 is pushed or pressed into the cane shaft's open end 56, the lock flanges 51 are deformed or deflected upwardly in generally dish-shaped fashion in order to prevent the handle from being withdrawn from operational assembly with the tubular shaft 11. The cane handle's stub shaft 50 is pushed further downwardly into the open end 56 of shaft 11 until shoulder section 70 enters tubular shaft 11 and until tapered surfaces 75 encounter the top edge of tubular shaft 11. Further downward movement of stub shaft 11 causes tapered surfaces 75 to be urged radially outwardly against the end 56 of shaft 11 thereby elasticly deforming shaft 11 to accommodate tabs 73. At about the sam time key 77 is received within keyway 79 to prevent rotation of handle 10 relative to shaft 11. As seat 57 on the cane handle's brace 18 bottoms out against the top edge 56 of that tubular shaft 11, the tabs 73 are fully received within the tubular shaft 11. Tabs 73 maintain the elastic deformation of tubular shaft 11 so that tubular shaft 11 tightly grips tabs 73 to further stabilize handle 10 and prevent its rocking relative to shaft 11.

Accordingly, the fastenerless lock 13 incorporated on the stub shaft 50 of the cane's handle 10 according to the alternate construction just described cooperates with the hollow tubular top end 56 of the cane shaft 11 via the deformable, friction fit annular locking flanges 51 so that the locking flanges 51 resist pulling of the handle's stub shaft 50 out from the cane shaft while key 77 and keyway 79 resist turning of the handle's stub shaft relative to the tubular cane shaft. Stub shaft 50 and therefore handle 11 are further stabilized relative to shaft 11 due to the close fitting engagement of shoulder section 70 within shaft 11 as well as by the gripping engagement of tabs 73 by the upper end of shaft 11, thereby creating a permanent interconnect or lock between the two cane 10, 11 components.

Having described in detail the preferred embodiment of my invention, what I desire to claim and protect by Letters Patent is:

1. A cane comprising a handle;

a tubular shaft connected to said handle; and a fastenerless lock by which said handle is connected with said shaft, said fastenerless lock comprising a stub shaft formed integral with said handle, said stub shaft being receivable in said tubular shaft;

a series of lock oriented generally normal to said stub shaft's axis when said handle is not assembled with said tubular shaft, said lock flanges prior to assembly being of slightly greater outside diameter than the inside diameter of said tubular shaft, said lock flanges being deformed upwardly in generally dish-shaped configuration when said handle's stub shaft is inserted into said tubular shaft in order to prevent said handle from being withdrawn from operational assembly with said tubular shaft;

a shoulder section formed on said stub shaft between said handle and said series of lock flinger, said shoulder section being slip fitably received within said tubular shaft; and a plurality of radially outwardly projecting tabs disposed on said shoulder section, said tabs being receivable within said tubular shaft and slightly oversized relative thereto elasticly deform said tubular shaft thereby stabilizing said shoulder section within said tubular shaft to prevent rocking of said handle relative said tubular shaft.

2. A handle for a cane having a tubular shaft, said handle comprising a hand grip;

a stub shaft connected to said hand grip;

a series of annular lock flanges on said stub shaft oriented generally normal to said stub shaft's axis when said handle is not assembled with said tubular shaft said lock flanges prior to assembly being of a slightly greater outside diameter than the inside diameter of said tubular shaft, said lock flanges being deformed upwardly in generally dish-shaped configuration when said handle's stub shaft is inserted into said tubular shaft in order to prevent said handle from being withdrawn from operational assembly with said tubular shaft; and a series of lock ribs disposed on said stub shaft, said lock ribs extending radially outward from, and generally parallel to, said stub shaft's axis, said lock ribs being receivable within the tubular shaft in a fashion that tends to deform the original inside tubular periphery of the tubular shaft toward a cross-sectional configuration other than its original configuration, thereby tending to prevent rotational movement of said cane handle relative to said tubular shaft after assembly.

3. A handle for a cane having a tubular shaft, said handle comprising a hand grip;

a stub shaft connected to said hand grip;

a series of annular lock flanges on said stub shaft oriented generally normal to said stub shaft's axis when said handle is not assembled with said tubular shaft, said lock flanges prior to assembly being of a slightly greater outside diameter than the inside diameter of said tubular shaft, said lock flanges being deformed upwardly in generally dish-shaped configuration when said handle's stub shaft is inserted into said tubular shaft in order to prevent said handle from being withdrawn from operational assembly with said tubular shaft; and a shoulder section formed on said stub shaft between said grip and said series of lock flanges, said shoulder section being slip fitably received within said tubular shaft; and a plurality of radially outwardly projecting tabs disposed on said shoulder section, said tabs being receivable within said tubular shaft and slightly oversized relative thereto to elasticly deform said tubular shaft thereby stabilizing said shoulder section within said tubular shaft to prevent rocking of said handle relative said tubular shaft.

4. A handle for a cane having a tubular shaft, said handle comprising a hand grip;

a stub shaft connected to said hand grip;

a series of annular lock flanges on said stub shaft oriented generally normal to said stub shaft's axis when said handle is not assembled with said tubular shaft, said lock flanges prior to assembly being of a slightly greater outside diameter than the inside diameter of said tubular shaft, said lock flanges being deformed upwardly in generally dish-shaped configuration when said handle's stub shaft is inserted into said tubular shaft in order to prevent said handle from being withdrawn from operational assembly with said tubular shaft; and a key formed on said shoulder section said key being receivable within a keyway on said tubular shaft to prevent rotation of the handle relative said tubular shaft.

5. A fastenerless lock system by which a first component is connected with a second component, said fastenerless lock system comprising a stub shaft connected to said first component, a tubular shaft connected to said second component, said stub shaft being telescopingly receivable in said tubular shaft, a series of lock flanges oriented generally normal to said stub shaft's axis when said stub shaft is not assembled with said tubular shaft, said lock flanges prior to assembly being slightly greater outside diameter than the inside diameter of said tubular shaft, said lock flanges being deformed upwardly in generally dish-shaped configuration as said stub is inserted into said tubular shaft in order to prevent said stub shaft from being withdrawn from operational assembly with said tubular shaft, a shoulder section formed on said stub shaft, said shoulder section being slip fitably received within said tubular shaft, and a plurality of radially outwardly projecting tabs disposed on said shoulder section, said tabs being receivable within said tubular shaft and slightly oversized relative thereto elasticly deform said tubular shaft for stabilizing said shoulder section within said tubular shaft to prevent rocking of said stub shaft relative to said tubular shaft.

* * * * *

UNITED STATES PATENT AND TRADEMARK OFFICE

CERTIFICATE OF CORRECTION

PATENT NO. : 4,834,127

DATED : May 30, 1989

INVENTOR(S) : David P. VanSice

It is certified that error appears in the above-identified patent and that said Letters Patent is hereby corrected as shown below:

Column 2, line 19, delete "ar" and insert --are--.

Column 5, line 23, delete "sam" and insert --same--.

Column 5, line 57 delete "lock oriented" and insert --lock flanges oriented--.

Column 5, line 68, delete "flinger" and insert --flanges--.

Signed and Sealed this

Sixth Day of March, 1990

*Attest:*

JEFFREY M. SAMUELS

*Attesting Officer*

*Acting Commissioner of Patents and Trademarks*